United States Patent [19]

Underwood et al.

[11] 4,203,362

[45] May 20, 1980

[54] ADJUSTABLE SELF-INKING STAMPING DEVICE

[75] Inventors: James L. Underwood, Kennesaw, Ga.; Sol Shapiro, Charlotte, N.C.

[73] Assignee: Adjusta-Mounts, Inc., Atlanta, Ga.

[21] Appl. No.: 957,138

[22] Filed: Nov. 2, 1978

[51] Int. Cl.[2] ..... B41F 1/38

[52] U.S. Cl. ..... 101/327; 101/405

[58] Field of Search ..... 101/379, 405, 406, 334, 101/333, 368, 103, 109

[56] References Cited

U.S. PATENT DOCUMENTS

| | | | |
|---|---|---|---|
| 42,819 | 5/1864 | Jenks | 101/406 |
| 1,179,979 | 4/1916 | Troup | 101/406 |
| 1,353,994 | 9/1920 | Folger et al. | 101/327 X |
| 2,839,994 | 6/1958 | Haag | 101/372 |
| 2,900,902 | 8/1959 | Becker | 101/327 X |
| 2,950,676 | 8/1960 | Weissman et al. | 101/405 |
| 3,033,112 | 5/1962 | Cleveland et al. | 101/327 X |
| 3,362,326 | 1/1968 | Delpo et al. | 101/405 X |
| 3,832,947 | 9/1974 | Funahashi | 101/327 |
| 4,022,127 | 5/1977 | Carlsson et al. | 101/327 |

FOREIGN PATENT DOCUMENTS

| | | | |
|---|---|---|---|
| 584709 | 9/1933 | Fed. Rep. of Germany | 101/406 |

*Primary Examiner*—E. H. Eickholt

*Attorney, Agent, or Firm*—Richards, Shefte & Pinckney

[57] ABSTRACT

A manual self-inking stamping device including a base for contacting material to be stamped, such base having a recess in which a self-inking stamp pad is supported for vertical movement with respect thereto. A depressable handle threadedly engages a shaft extending through the base from the stamp pad, and a movable member is disposed about the shaft for selective meshing engagement with the base at one end of the movable member and for engagement with the handle at the other end to lock the handle against rotational movement about the shaft. A spring disposed intermediately of the handle and the movable member urges the handle and the stamp pad upwardly and urges the movable member into engagement with the base. The handle may be depressed against the biasing force of the spring to bring the stamp pad into contact with the material to be stamped, the movable member acting as a stop to restrict the vertical depression of the handle. The stamping pressure which may be exerted against the material may be varied by adjusting the effective length of the shaft between the handle and the movable member by moving the movable member upwardly out of meshing engagement with the base and rotating the handle about the shaft.

7 Claims, 6 Drawing Figures

FIG. 1
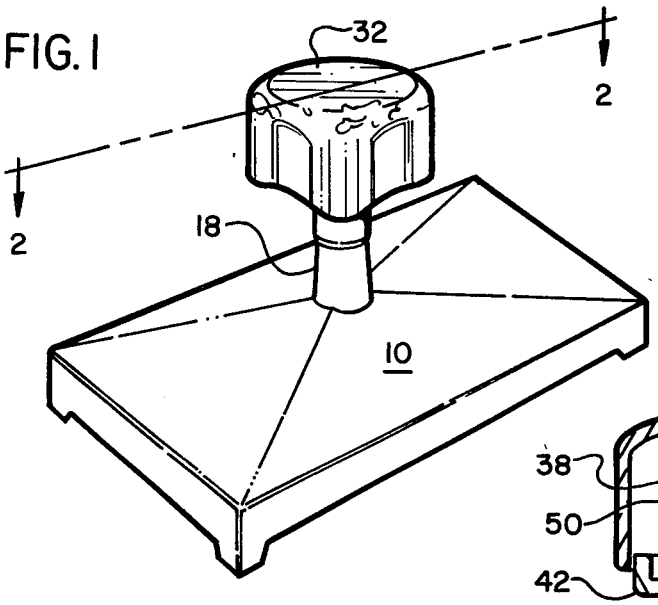
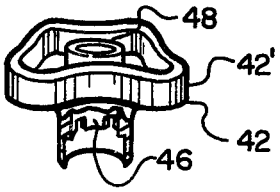
FIG. 6
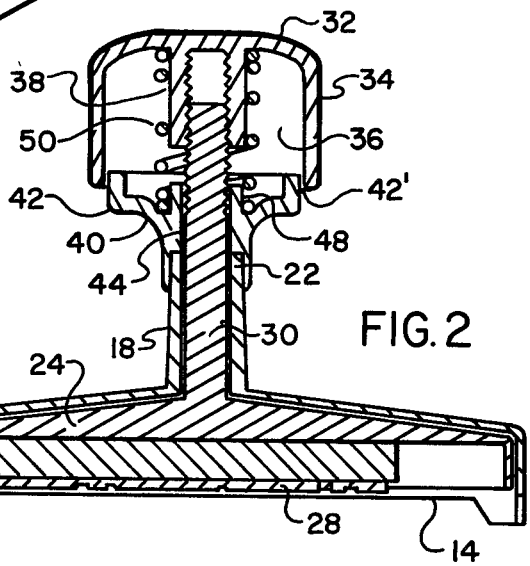
FIG. 2
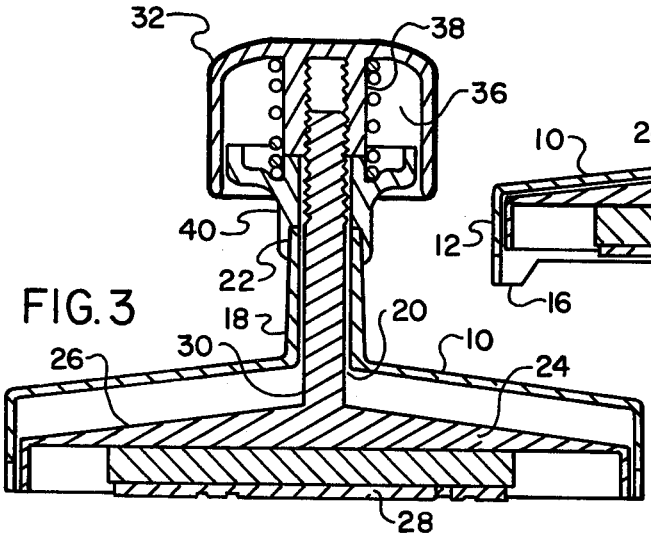
FIG. 3
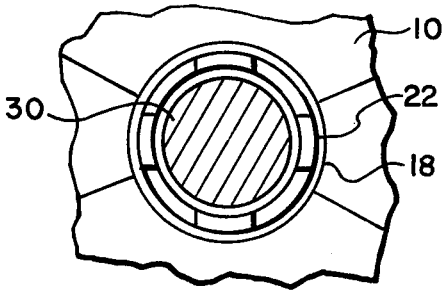
FIG. 5
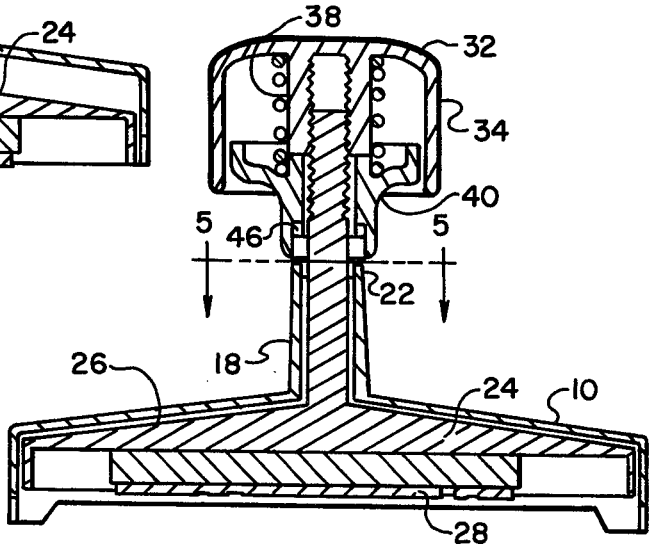
FIG. 4

ADJUSTABLE SELF-INKING STAMPING DEVICE

BACKGROUND OF THE INVENTION

The present invention relates to manual self-inking stamping devices of the type having a self-inking stamp pad for impressing any suitable surface with a printed message, design or the like. Typical prior art devices utilize a base member for receiving therein the stamp pad, a depressable handle affixed to the stamp pad for effecting contact of the stamp pad with the surface to be stamped, and biasing means for normally urging the stamp pad upwardly within the base means. The handle may be depressed against the urging of the biasing means to cause the stamp pad to contact the surface to be stamped. While these devices provide generally satisfactory printing results, they suffer from the disadvantage that the stamping pressure exerted in depressing the handle cannot be uniformly regulated. When the self-inking stamp pad is relatively new, and therefore has an ample supply of ink retained therein, only a light depressing force on the handle is necessary to effect satisfactory printing. However, when the stamp pad has been in use for a considerable length of time, a relatively greater depressing force must be exerted on the handle to achieve comparable printing. The accurate regulation of the depressing force necessary to achieve uniform printing results throughout the useful life of the stamp pad is not possible with such prior art stamping devices.

Other prior art stamping devices have employed various means allowing selective adjustment of the distance which the handle may be depressed thereby facilitating regulation of the stamping pressure exertable upon depression of the handle. One such prior art device employs a two-part bushing disposed below the handle of the stamping device and about a shaft extending from the handle to the stamp pad to act as a stop to restrict vertical depression of the handle, the two bushing parts being threadedly connected so that the length of the entire bushing unit is variable by rotation of the respective bushing parts thereby varying the distance which the handle may be depressed. Another known prior art device utilizes a cam unit having a sloping cam surface disposed to act as a stop for the handle, the cam unit being either rotatable or slidable to vary the effective height of the cam surface thereby regulating the distance which the handle may be depressed.

SUMMARY OF THE INVENTION

The present invention provides a manual self-inking stamping device including base means for contacting the material to be stamped, the base means having a downwardly open recess therein, and stamp pad means disposed within the recess for relative vertical movement with respect thereto. The stamp pad means has a shaft fixed thereto which extends outwardly through the base means with handle means being mounted at the extending end of the shaft for vertical movement therewith, the handle means being selectively positionable along the length of the shaft. Stop means is disposed in the vertical path of movement of the handle means for abutment therewith during downward vertical movement thereof. Biasing means is disposed intermediately of the handle means and the base means for urging the handle means away from the stop means and the base means, and for normally biasing the stamp pad means attached to the shaft upwardly within the recess of the base means. Selectively operable locking means is associated with the shaft for movement between an operating disposition at which the locking means simultaneously engages the handle means and the base means to lock the handle means against the positioning movement thereof along the shaft, whereby the handle means may be depressed against the biasing force of the biasing means to cause the stamp pad means to contact the material to be stamped, and an adjusting disposition in which the handle means may be selectively positioned along the shaft to vary the effective length of said shaft between the handle means and the stop means and thereby vary the distance the handle means may be moved vertically downwardly before abutting the stop means so that the resulting stamping pressure exerted against the material to be stamped is correspondingly varied.

In the preferred embodiment of the present invention, the locking means comprises a movable member disposed about the shaft between the handle means and the base means which is movable between the operating disposition and the adjusting disposition. The movable member includes first engaging means at one end thereof to engage the handle means and second engaging means at the other end thereof to engage the base means at the operating disposition thereof, the movable member being disengaged from at least one of the base means or the handle means at the adjusting disposition thereof. The aforesaid biasing means normally urges the movable member toward the operating disposition.

It is additionally preferred that the handle means include a wall portion defining a downwardly open cavity of generally square shape and that the first engaging means of the movable member include a generally square shaped portion at one end thereof, the handle closely surrounding the square shaped portion of the movable member. The base means includes a plurality of projections extending upwardly therefrom and the second engaging means of the movable member includes a plurality of ribs spaced about the other end thereof disengagably meshing with the projections when the movable member is at the operating disposition. Thus, the movable member may be moved into the adjusting disposition by moving it upwardly within the cavity of the handle against the biasing force of the biasing means thereby disengaging the ribs from the projections. The handle means preferably threadedly engages the shaft whereby the handle means may be rotated about the shaft when the locking means is at the adjusting disposition to selectively position it therealong.

BRIEF DESCRIPTION OF THE DRAWINGS

FIG. 1 is a perspective view of a manual self-inking stamping device illustrating the preferred embodiment of the present invention;

FIG. 2 is a vertical sectional view of the stamping device of FIG. 1 taken along line 2—2 of FIG. 1;

FIG. 3 is a sectional view similar to FIG. 2 but illustrating the stamping device of the present invention with the handle means thereof depressed;

FIG. 4 is a sectional view similar to FIG. 2 but illustrating the stamping device of the present invention with the selectively operable locking means in its adjusting disposition;

FIG. 5 is a detail view of the stamping device of the present invention taken along line 5—5 of FIG. 4; and FIG. 6 is a perspective view of the movable member of the present invention, with the lower portion thereof broken away to show the ribs thereof.

DESCRIPTION OF THE PREFERRED EMBODIMENT

Referring now to the accompanying drawings, a manual self-inking stamping device incorporating the preferred embodiments of the present invention is illustrated perspectively in FIG. 1. The stamping device includes a generally rectangular base member 10 comprising a rectangular housing portion 12 having a downwardly open recess 14 therein and four feet 16, each being located at and extending downwardly from one corner of the rectangular housing portion 12. The base member 10 also includes a sleeve portion 18 which extends upwardly from the housing portion 12 and communicates with a hole 20 formed therein, the sleeve 18 having a plurality of upwardly extending projections 22 spaced radially about the upper edge thereof. A stamping member 24 is provided and includes a backing plate 26 having a self-inking stamp pad 28 affixed to the lower side thereof and a shaft 30 rigidly affixed to and extending upwardly from the upper side thereof. The stamping member 24 is disposed within the recess 14 of the rectangular housing portion 21 with the shaft 30 thereof extending upwardly through the hole 20 for relative vertical movement with respect thereto, the backing plate 26 being vertically movable within the recess 14 with the shaft 30 being vertically slidable through the hole 20 and within the sleeve 18. A handle 32 is provided which includes a vertical wall portion 34 forming a downwardly open cavity 36 of generally square shape, and an interiorly threaded sleeve 38 extends downwardly at the center of the handle 32. The extending end of the shaft 30 is threaded for engagement with the threaded sleeve 38 whereby the handle 32 may be rotated about the shaft 30 to selectively position it along the length thereof.

A selectively operable locking member 40 is provided with a central bore 44 that slidably receives the shaft 30, and the locking member 40 includes an outwardly flared wall portion 42 having a generally square shape and presenting an exterior surface 42' that is surrounded in close proximity by the correspondingly square-shaped handle wall portion 34. The locking member 40 is also formed with a plurality of engaging ribs 46 spaced radially within the bore 44 adjacent the lower end of the locking member 40 which normally meshingly engage the projections 22.

A stop is disposed in the vertical path of movement of the handle means 32 for abutment therewith during downward vertical movement thereof, the stop comprising a vertical shoulder 48 formed on the locking member 40 within the square shaped wall portion 42 thereof concentric with the bore 44 for abutment with the sleeve 38 of the handle 32 when the handle 32 is depressed. A coil spring 50 is disposed intermediately of the handle 32 and the locking member 40 for urging the handle 32 away from the shoulder 48 and away from the base 10, thereby normally biasing the stamping member 24 upwardly within the recess 14 of the base 10. The coil spring 50 is disposed about the shaft 30 with the upper end of the spring 50 encircling the sleeve 38 and with the lower end of the spring 50 encircling the shoulder 48 (see FIG. 2). In this manner, the locking member 40 is normally urged by the spring 50 away from the handle means 32 with the ribs 46 in meshing engagement with the projections 22.

The stamping device of the present invention is normally maintained in the disposition shown in FIGS. 1 and 2 with the spring 50 acting between the handle 32 and the locking member 40 to urge the handle 32, the shaft 30 and the stamping member 24 upwardly, and to urge the locking member downwardly against the base sleeve 18. At this operating or locking disposition of the locking member 40, it will be noted that the locking member 40 is held against rotation because of the meshing engagement between the ribs 46 and the projections 22 and the handle 32 is likewise held against rotation about the shaft 30 because the square wall portion 34 of the handle 32 surrounds the square wall portion 42 of the non-rotating locking member 40. Therefore, the handle 32 is locked against adjusting rotation along the shaft 30. In the preferred embodiment of the present invention, the handle wall portion 34 and locking member wall portion 42 have generally square configurations; other straight sided configurations (e.g. triangular shapes) could also be used without departing from the scope of the invention.

To operate the stamping device of the present invention, the base 10 is positioned with the feet 16 thereof in contact with the material to be stamped (not shown) and the handle 32 is vertically depressed against the biasing force of the spring 50 to cause downward vertical movement of the shaft 30 and the stamping member 24, thereby causing the stamp pad 28 to be pressed into stamping contact with the material to be stamped, the shoulder 48 of the locking member 40 acting as a stop to restrict the vertical depression of the handle 32, as shown in FIG. 3.

As the stamping device is used and the ink stored within the stamp pad 28 is gradually expended, it will become necessary to exert proportionately greater stamping pressure against the material to be stamped in order to achieve satisfactory printing results. To facilitate the required increase in stamping pressure, the locking member 40 may be moved from its aforesaid operating disposition to an adjusting disposition shown in FIG. 4. To move the locking member 40 into the adjusting disposition, the bottom face of the locking member 40 is grasped by the fingers of the user and is moved upwardly within the cavity 36 of the handle 32 against the biasing force of the spring 50 thereby disengaging the ribs 46 thereof from the projections 22. Upon disengagement of the ribs 46 from the projections 22, the handle 32 and the locking member 40 may be rotated as a unit about the shaft 30 thereby allowing the handle 32 to be selectively positioned along the length of the shaft 30. When the handle 32 has been rotated to assume a desired location along the length of the shaft 30, the locking member 40 is released whereupon the spring 50 will cause it to be moved downwardly into engagement with the projections 22. In this manner, the effective length of the shaft 30 between the handle 32 and the shoulder 48 may be varied, thereby varying the distance the handle 32 will be moved vertically downwardly before the sleeve 38 thereof abuts the shoulder 48 of the locking member 40. As a result, the stamping pressure which may be exerted against the material to be stamped is correspondingly varied.

Thus, the stamping device of the present invention has a simple construction which may be economically reproduced, and all parts except the conventional spring 50 and conventional stamping member 24 may be molded from plastic and assembled without special tools. Additionally, the adjustment of the handle 32 requires no special tools, and can generally be carried out quickly and easily by the user with only one hand since the user can hold the handle 32 in the palm of the hand while grasping the locking member 40 with the fingers of the hand to raise the locking member 40 and permit rotating adjustment of the handle 32.

The present invention has been described herein with particular reference to the accompanying drawings which illustrate the best mode presently contemplated for the present invention. However, it should be understood that this invention is viewed as having a broad utility and is not restricted to the specific construction and uses hereinabove described and illustrated. For example, although in the preferred embodiment just described the locking means 40 is moved into the adjusting disposition by moving the movable member 42 upwardly within the cavity 36 of the handle means 32 to disengage the ribs 46 thereof from the projections 22, it is contemplated that an alternate embodiment could be constructed without departing from the scope and substance of the present invention, in which the movable member 42 is moved so as to disengage the square portion 44 thereof from the square-shaped cavity 36 of the handle means 32. Such modifications and variations are within the scope of the present invention, which is intended to be limited only by the appended claims and equivalents thereof.

We claim:

1. A manual self-inking stamping device comprising:

(a) base means for contacting material to be stamped, said base means having a downwardly open recess therein, (b) stamp pad means disposed within said recess of said base means for relative vertical movement with respect thereto, said stamp pad means having a shaft fixed thereto and extending outwardly through said base means, (c) handle means mounted at the extending end of said shaft for vertical movement therewith, said handle means being selectively positionable along the length of said shaft;

(d) stop means disposed in the vertical path of movement of said handle means for abutment therewith during downward vertical movement thereof, (e) biasing means disposed intermediately of said handle means and said base means for urging said handle means away from said stop means and said base means, and for normally biasing said stamp pad means upwardly within said recess of said base means, and (f) selectively operable locking means associated with said shaft for movement between an operating disposition in which said locking means simultaneously engages said handle means and said base means to lock said handle means against said positioning movement thereof along said shaft, whereby said handle means may be depressed against the biasing force of said biasing means to cause said stamp pad means to contact the material to be stamped, and an adjusting disposition in which said handle means may be selectively positioned along said shaft to vary the effective length of said shaft between said handle means and said stop means and thereby vary the distance said handle means may be moved vertically downwardly before abutting said stop means so that the resulting stamping pressure exerted against the material to be stamped is correspondingly varied.

2. A manual self-inking stamping device according to claim 1 and characterized further in that said biasing means biases said locking means toward said operating disposition thereof.

3. A manual self-inking stamping device according to claim 1 and characterized further in that said handle means threadedly engages said shaft whereby said handle means may be rotated about said shaft to selectively position it therealong when said locking means is at said adjusting disposition.

4. A manual self-inking stamping device according to claim 1 and characterized further in that said locking means comprises a movable member disposed about said shaft between said handle means and said base means and movable between said operating disposition and said adjusting disposition, said movable member including first engaging means at one end thereof to engage said handle means and second engaging means at the other end thereof to engage said base means at said operating disposition thereof, and being disengaged from at least one of said base means or said handle means at said adjusting disposition thereof.

5. A manual self-inking stamping device according to claim 4 and characterized further in that said movable member engages said handle means at both said operating disposition and said adjusting disposition, and in that said biasing means normally urges said movable member toward said operating disposition.

6. A manual self-inking stamping device according to claim 5 and characterized further in that said first engaging means of said movable member includes a generally square shaped portion at said one end of said movable member and said second engaging means of said movable member includes a plurality of ribs spaced about said other end thereof, in that said handle means includes a wall portion defining a downwardly open cavity of generally square shape closely surrounding said square shaped portion of said movable member, and in that said base means includes a plurality of projections extending upwardly therefrom for disengagable meshing with said ribs when said movable member is at said operating disposition, whereby said movable member may be moved into said adjusting disposition by moving it upwardly within said cavity of said handle against the biasing force of said biasing means thereby disengaging said ribs from said projections.

7. A manual self-inking stamping device comprising:

(a) a base for contacting material to be stamped, said base having a downwardly open recess therein and a sleeve extending upwardly from and communicating with a hole in said base, said sleeve having a plurality of projections spaced about the upper edge thereof, (b) a stamp pad backing plate having a self-inking stamp pad affixed to one side thereof and a shaft rigidly affixed to and extending from the other side thereof, said plate being vertically movable within said recess with said shaft being vertically slidable through said hole in said base, (c) a movable member formed with a bore extending therethrough to slidably receive said shaft, said movable member having a plurality of ribs disposed at one end thereof for selective engagement with said projections on said base, (d) a depressable handle threadedly engaging said shaft for selective movement therealong, said handle having a downwardly open cavity closely encircling said movable member to prevent rotational movement of said handle about said shaft when said movable member ribs are in meshing engagement with said projections, and (d) biasing means disposed intermediately of said movable member and said handle for urging said movable member away from said handle and into meshing engagement with said projections thereby normally biasing said stamp pad backing plate upwardly within said recess of said base, whereby said handle may be vertically depressed against the biasing force of said biasing means to cause said stamp pad to be pressed into stamping contact with material to be stamped, said movable member acting as a stop to restrict the vertical depression of said handle, and whereby said movable member may be moved upwardly within said cavity of said handle against the biasing force of said biasing means to disengage said ribs from said projections so that said handle may be rotated about said shaft to selectively vary the effective length of said shaft between said handle and said movable member and thereby vary the distance said handle may be depressed before it is stopped by said movable member so that the stamping pressure which may be exerted against the material to be stamped is correspondingly varied.

* * * * *